United States Patent [19]

Blunt

[11] Patent Number: 5,011,434

[45] Date of Patent: Apr. 30, 1991

[54] FILTERED ELECTRICAL CONNECTOR

[75] Inventor: Christopher W. Blunt, Faversham, United Kingdom

[73] Assignee: Amphenol Corporation, Wallingford, Conn.

[21] Appl. No.: 438,868

[22] Filed: Nov. 20, 1989

[30] Foreign Application Priority Data

Nov. 23, 1988 [GB] United Kingdom ..... 8827349

[51] Int. Cl.[5] ..... H01R 13/66

[52] U.S. Cl. ..... 439/620; 333/185

[58] Field of Search ..... 439/86, 89, 90, 595, 439/607, 620; 333/182, 183, 184, 185

[56] References Cited

U.S. PATENT DOCUMENTS

| | | | |
|---|---|---|---|
| 3,539,973 | 11/1970 | Antes et al. | 439/90 |
| 3,648,222 | 3/1972 | Cowmeadow | 439/620 X |
| 3,870,978 | 3/1975 | Dreyer | 439/86 |
| 4,029,386 | 6/1977 | Krantz, Jr. et al. | |
| 4,276,523 | 6/1981 | Boutros et al. | 439/620 X |
| 4,747,789 | 5/1988 | Gliha | 439/620 |

FOREIGN PATENT DOCUMENTS

| | | |
|---|---|---|
| 950047 | 2/1964 | United Kingdom . |
| 1257418 | 12/1971 | United Kingdom . |
| 2011737A | 7/1979 | United Kingdom . |
| 2014804A | 8/1979 | United Kingdom . |
| 2163012A | 2/1986 | United Kingdom . |

*Primary Examiner*—Neil Abrams
*Assistant Examiner*—Khiem Nguyen
*Attorney, Agent, or Firm*—Bacon & Thomas

[57] ABSTRACT

A filtered electrical connector has a number of removable filter contacts. Each contact has a ceramic capacitive casing located by means of resilient spacers. To prevent the resilient tines of the retaining plate and grounding disc catching on and causing damage to the capacitive casing and spacers, the metal parts of each conductor extend to shroud the spacers and abut the end of the capacitive casing. To increase available contact density within the connector, the grounding disc is moulded from flexible plastics material and plated with an electrically conductive coating.

21 Claims, 3 Drawing Sheets

FILTERED ELECTRICAL CONNECTOR

BACKGROUND OF THE INVENTION

This invention relates to two part electrical connectors and in particular to those having removable filter contacts.

Standard non-filter contacts are conventionally held in place in such connectors by means of a plastic retention disc. The retention disc has an aperture for each contact and on one side of the disc are formed a number of resilient tines about each aperture projecting from the surface of the disc and angled inwards. The contact is pushed through the aperture from the other side (the rear) of the plate, the tines flexing to allow its passage and then engaging behind a flange or shoulder on the contact to prevent withdrawal. Removal is achieved by insertion of a tool from the rear of the plate to spread the tines so that they are clear of the shoulder and the contact can be withdrawn.

Known types of filter contacts give rise to problems when used with a retention disc of the type described. Filter contacts of the stress-isolated type, which are designed to allow a certain amount of bending of the metal part of the contact whilst having a fragile ceramic capacitive casing around a part of the contact, have conductive rubber washers or spacers compressed between the metallic ends of the contact, or flanges spaced along its length, and the ends of the ceramic capacitive casing in the centre. The spacers provide the necessary electrically conductive path whilst permitting a significant bending of the ends of the contact without putting stress on or causing damage to the fragile ceramic casing. Due to the spacers being held in compression, it is inevitable that the outer wall of each spacer will bulge outwards between the flange on the contact and the end of the ceramic casing. If a contact of this type is withdrawn through the retention disc described above, the free ends of the tines are prone to catch on the bulging outer wall of the spacers or the ends of the ceramic capacitive casing. Repeated insertion and withdrawal of such a contact can lead to damage of the spacers, ceramic casing and tines.

A further problem which is encountered in the design of such electrical connectors, particularly of those having a high contact density, is the provision of a ground plane. It is a fundamental requirement of a filtered connector that each of the individual filter contacts must have their capacitive elements connected to a common system ground point, usually via the connector casing. This is conventionally achieved by either soldering each contact to a conductive plate or by provision of a metallic plate having spring characteristic through which each contact passes and in which contacting tines are formed. Soldering prevents the removal of contacts and the close proximity of the contacts in high density connectors makes the formation of springy tines in metallic plate impracticable.

United Kingdom Patent GB 1,257,418 describes a plate having spring characteristics. The plate of GB 1,257,418 provides a number of separate electrical connections between a wiring board and a demountable component assembly. There is no suggestion of passing capacitive filter through apertures in the plate nor of connecting all the connection points together and to ground potential. United Kingdom Patent GB 950,047 describes an edge connector for printed circuit boards which uses a number of separate sprung metal contacts.

As with GB 1,257,418, there is no suggestion of use with capactive filter contacts nor of electrically connecting all of the contacts together and to ground potential.

SUMMARY OF THE INVENTION

In accordance with a first aspect of the present invention there is provided a contact for use in a filtered electrical connector, said contact comprising:

a longitudinally extending electrically conductive body;

a pair of flanges projecting outwardly from said conductive body and spaced from one another along the length of said conductive body;

a capacitive casing which surrounds a portion of said electrically conductive body between said pair of spaced flanges; and resilient conductive spacers held in compression between each end of said capacitive casing and an adjacent one of said spaced flanges to support said capacitive casing relative to said conductive body; wherein said contact further comprises:

a hollow shell extending from each of said pair of spaced flanges towards the adjacent end of said capacitive casing, each of said hollow shells overlying at least a part of the outer surface of said resilient conductive spacer between said flange from which said hollow shell extends and the adjacent end of said capacitive casing.

By covering a substantial part of the outer surface of each spacer, the tines are less likely to catch on them, reducing the wear and damage caused by repeated insertion and withdrawal of contacts. Preferably, the distance between the annular edges of the hollow shells on the pair of flanges is slightly greater than the length of the capacitive casing therebetween.

In accordance with a second aspect of the present invention there is provided a grounding disc for use with capacitive filter contacts in a filtered electrical connector, said grounding disc comprising:

a plate having one or more apertures through which extends a single capacitive filter contact; and one or more resilient tines about each of said one or more apertures, said resilient tines contacting a capacitive filter contact extending through said aperture; wherein said grounding disc is moulded of resilient plastics material and has formed on at least a part of its surface a layer of conductive material which extends over the surface of at least one of said one or more tines adjacent each said aperture so as to connect electrically to ground potential the external surfaces of each or all of said capacitive filter contacts extending through said plate.

Where the electrical path to ground potential is provided by the connector casing, it is necessary to ensure good electrical contact between this and the layer of conductive material on the grounding disc. This may be achieved by filling the aperture between the two parts with an electrically conductive elastomer or a similar suitable material. Alternatively, spring contacts may be provided which, when positioned, are in good electrical contact with the two parts.

Preferably, the moulded plastics disc is plated with copper and silver with the plated tines contacting each capacitive casing to provide a common ground connection. Being manufactured from a resilient plastics material, the tines are flexible enough to allow the removal and insertion of filter contacts on numerous occasions without damage to either the grounding disc tines or the filter contacts. At the same time, the tines are sufficiently stiff to provide support for the fragile ceramic capacitive tube of a filter contact against damage from internal shock and vibration.

BRIEF DESCRIPTION OF THE DRAWINGS

An embodiment of the invention will now be described by way of example and with reference to the accompanying drawings in which.

DETAILED DESCRIPTION OF A PREFERRED EMBODIMENT

Figure 1:
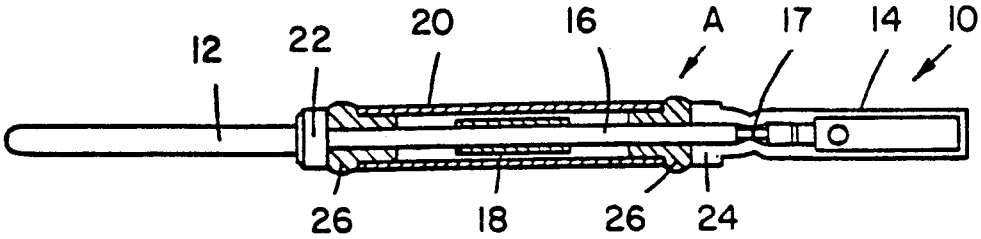
PRIOR ART FIG. 1
FIG. 1 is a sectional view of a known type of filter contact.

Referring initially to FIG. 1, a known type of capacitive male filter contact 10 for use in one part of a two part electrical connector is shown. The front portion 12 of the contact 10 is shaped to engage a female contact (not shown) in the other part of the two part connector. The rear portion 14 of the contact 10 is so shaped as to be connectable to one of the conductors of a cable (not shown) on which the connector is mounted. Connecting the front and rear portions 12,14 both electrically and mechanically is a longitudinally extending central conductor 16. The front portion 12 and central conductor 16 are welded together or produced as a single item. The rear portion 14 has a longitudinally extending bore into which the rear end of the central conductor 16 is inserted to a controlled depth. Retention of the rear portion 14 in the bore is achieved by means of a reduced diameter section 17 of the central conductor 16, around which the rear portion 14 is crimped as shown. A sleeve 18 of ferrite material is mounted on and surrounds a central region of the central conductor 16. Between the front and rear portions 12 and 14 of the contact 10 shrouding the central conductor 16 and ferrite sleeve 18, is a capacitive casing 20 of ceramic material. At the rear end of the front portion 12 adjacent the central conductor 16, there is an outwardly-projecting flange 22. A second flange 24 is formed at the forward end of the rear portion 14 around the central connector 16. A conductive rubber spacer 26 is held in compression between each of the two flanges 22,24 and the adjacent end of the capacitive casing 20. The distance between the two flanges 22,24 and hence the degree of compression on the conductive spacers 26 is controlled by the depth to which the central conductor 16 is inserted and held in the rear portion 14. The spacers 26 serve to support the capacitive casing 20 whilst permitting a degree of flexing of the central conductor 16 relative to the rigid ceramic casing 20.

Figure 2:
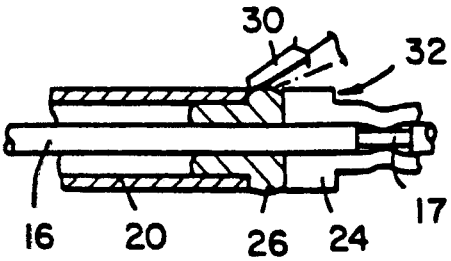
PRIOR ART FIG. 2
FIG. 2 shows a detail of the part indicated at "A" in FIG. 1.
Figure 4:
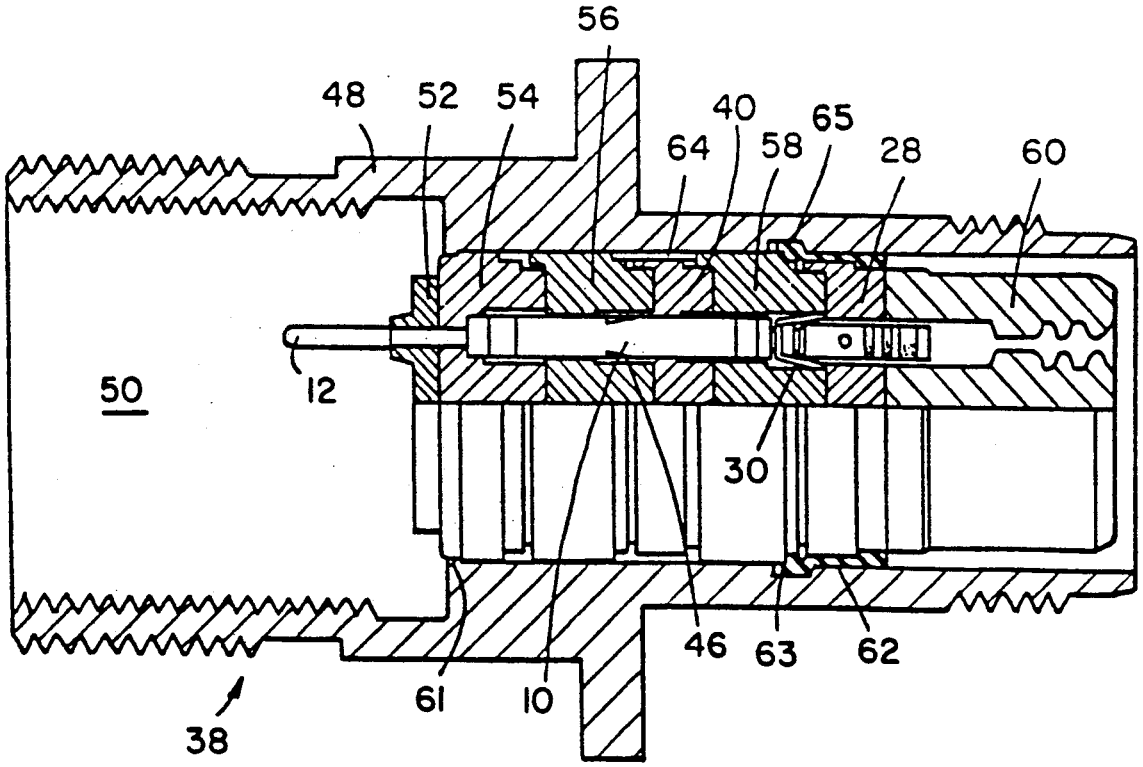
FIG. 4 is a sectional view of one part of a two part electrical connector of MIL C 38999 type, including the filter contact and grounding disc of the present invention.

The problem caused by the outward bulding of the outer wall of the conductive rubber spacers 26 is illustrated in FIG. 2. Removable contacts 10 of this type are held in position in the electrical connector by a retaining plate 28 (FIG. 4). The retaining plate 28 has an aperture through which the contact 10 is passed from one side with a number of resilient tines 30 on the other side. The tines 30 are angled forwards and inwards. As the contact 10 is inserted through the aperture the tines 30 flex outwards to allow the contact 10 to pass between them and then spring back to an unflexed position in which their ends engage behind the shoulder 32 formed at the rear of the flange 24 to oppose withdrawal of the contact. To remove the contact 10 from the connector a tool is inserted from the rear to bend the tines 30 so that the ends are clear of the flange 24. In practice, however, the ends of the tines 30 catch on the outer wall of the rubber spacers 26 or the ends of the capacitive casing 20 as shown.

Figure 3A:
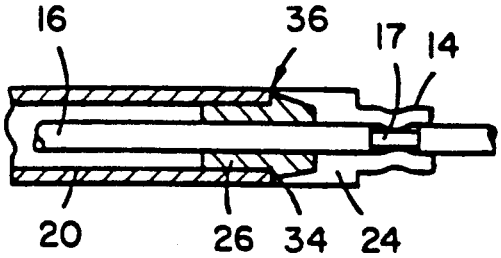
FIG. 3A shows the part of FIG. 2 modified in accordance with one aspect of the invention.
Figure 3B:
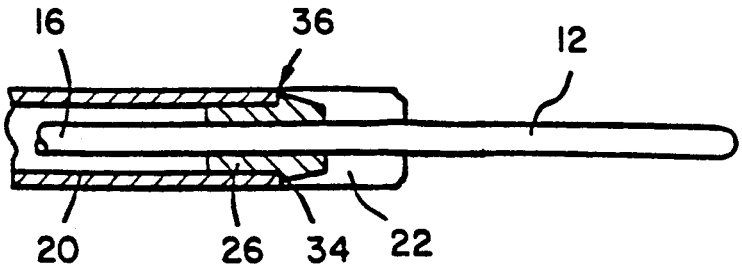
FIG 3B shows the other part of FIG. 2 modified in accordance with one aspect of the invention.

In order to overcome this difficulty an alternative form of spacer and contact arrangement is proposed as shown in FIGS. 3A and 3B. As can be seen in FIGS. 3A and 3B, a hollow cylindrical extension or shell 34 is provided on each of the flanges 22,24 extending towards the capacitive casing 20. The distance between the annular edges of the extensions 34 is set to be slightly greater than the length of the capacitive casing 20 so that there is a small space 36 between the ends of the extensions 34 and the capacitive casing 20. This ensures that the contact 10 retains a degree of flexibility without damaging the fragile ceramic of the capacitive casing 20.

A part of the length of the spacer 26 is enclosed by the end of the capacitive casing 20 with a substantial part of the remainder shrouded by the adjacent extension 34, as shown. The small space 36 is large enough to permit flexing of the central conductor 16 without the annular edges of the extensions 34 contacting the capacitive casing 20. The small space 36 is, however, not so large as to allow the outer wall of the conductive rubber spacer 26 to bulge outwards. The outside diameters of each extension 34 and the capacitive casing 20 are substantially the same so that apart from the small spaces 36, the peripheral surfaces thereof form a substantially continuous, smooth outer surface of the cotact 10. This reduces the probability of the ends of the tines 30 catching on the outer surface of the contact 10, and thus reduces the wear and damage caused by repeated insertion and withdrawal of the contact.

FIG. 4 shows the mounting arrangements of a capacitive filter contact 10 in the shell of a typical connector part 38.

The connector part 38 comprises a casing 48 in which one or more filter contacts 10 are mounted. At the forward end of the casing 48, there is an opening 50 through the rear wall of which project the front portions 12 of the filter contacts 10. Around these projecting front contact portions 12 is a face seal 52 of a known type which prevents the ingress of water and dirt into the casing 48. To the rear of the face seal 52 are respectively a front insert 54, also of a known type, a first spacer plate 56, a grounding disc 40, a second spacer plate 58 identical to the first spacer plate 56 and a retaining plate 28. Each of these has apertures formed in it through which one or more contacts 10 may be passed. Behind the retaining plate 28 at the rear of the connector part 38 (shown on the right of FIG. 4) is a cable grommet 60 which acts to prevent the ingress of dirt or moisture and provides strain relief. Movement of each contact 10 in a forward direction is prevented by the front insert 54, the apertures in which are of a large enough diameter for only the front contact portions 12 to pass through. Rearward motion is prevented by the engagement of the tines 30 of the retaining plate 28 with the shoulder 32 on the flange 24 of the rear portion 14 of the contact 10. Forward movement of the front insert 54 is prevented by the outer edge thereof abuting a locating flange 61 formed on the inner surface of the connector casing 48 at the rear wall of the opening 50. Rearward motion of the retaining plate 28 is prevented by use of a staking ring 62 in the annular cavity 63 defined by the outer surface of the retaining plate 28 and the connector casing 48. The staking ring 62 is fitted to the retaining plate 28 from the rear and abuts a shoulder on the outer surface thereof. When inserted in the connector casing 48, the staking ring 62 engages a radial groove 65 in the inner surface of the casing 48 preventing rearward motion of both the staking ring 62 and retaining plate 28. Positioned in the connector casing 48 the front insert 54 firt spacer plate 56, grounding disc 40, second spacer plate 58 and retaining plate 28 are held in close contact thus preventing forward or rearward motion of all of these components. As with the retaining plate 28, there is an annular cavity 64 defined between the outer surface of the grounding disc 40 and the connector casing 48. To provide the required electrical contact between the grounding disc 40 and connector casing 48, the cavity 64 is filled with an electrically conductive elastomer. This is done either during assembly or after assembly by injection of the elastomer through a suitable hole in the connector casing 48. In an alternative embodiment (not shown) the conductive elastomer is replaced by a flat spring strip of electrically conductive material in which are formed a number of tines. The strip is wrapped around the grounding disc 40 and, in position, the tines contact both the grounding disc 40 and the connector casing 48.

Figure 5:
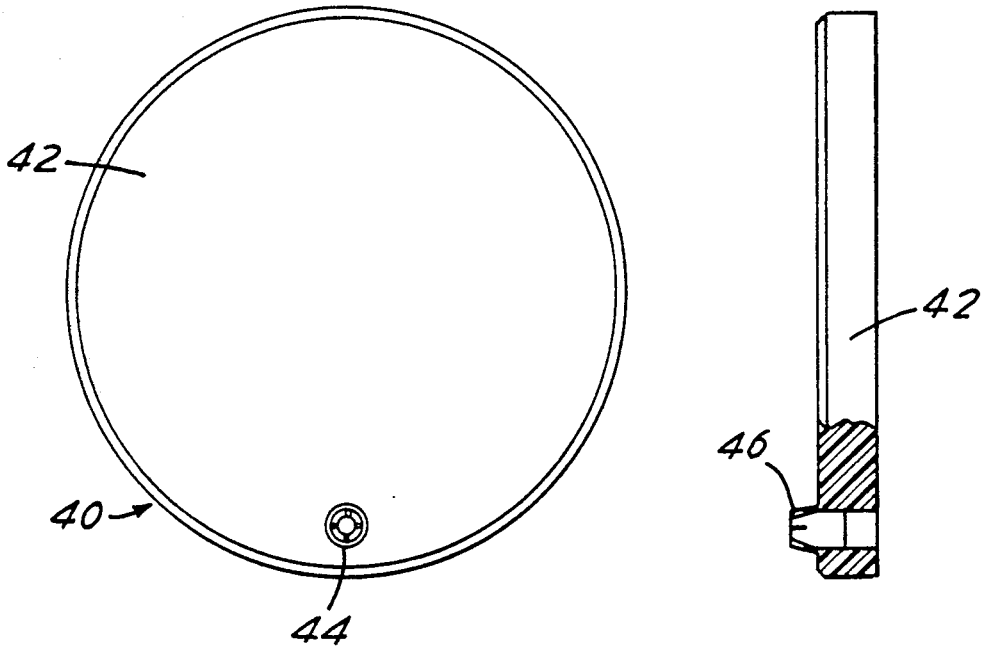
FIG. 5 is a plan and part-sectioned elevation of a grounding disc in accordance with the second aspect of the present invention.
Figure 6:
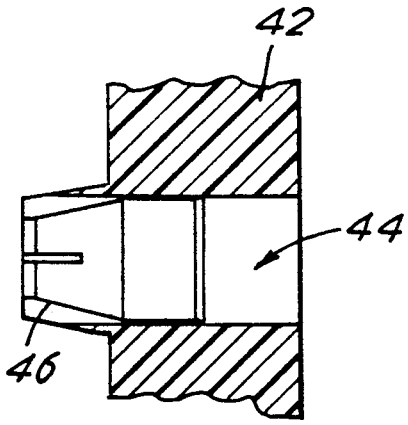
FIG. 6 is a detail of the part indicated at "B" in FIG. 5.

The grounding disc 40 is shown in greater detail in FIGS. 5 and 6. The grounding disc 40 is of substantially the same design as the retaining plate 28 and comprises a plate 42 having one or more apertures 44 through each of which a contact 10 may be passed and resilient tines 46 around each aperture 44 on one side of the plate 42. The grounding disc 40 is made from flexible plastics material and plated with copper and silver over its entire surface to provide a continuous conducting layer. In use, the grounding disc 40 is located so that when a removable filter contact 10 is inserted through the aperture 44, the resilient tines 46 are sprung against the capacitive casing 20, as shown in FIG. 4. In this way, the capacitive casing 20 of each contact 10 is connected to a common ground. The use of moulded plastics material for the disc means that a far greater density of apertures and resilient tines can be achieved, in comparison with known designs of removable filter contact connectors.

Figure 7:
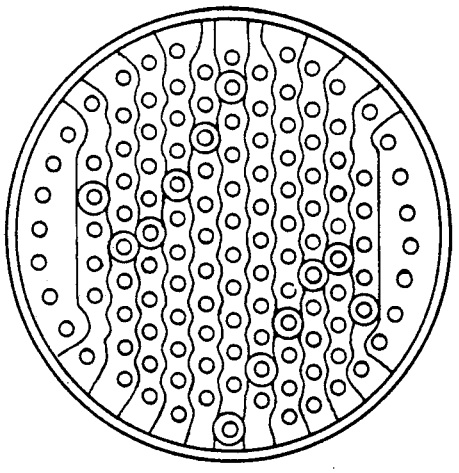
FIG. 7 is a diagrammatic illustration of the contact positioning of an MIL C 38999 connector.

The use of the filtered contact 10 and grounding disc 40 of the present invention permit the construction of electrical connectors in which the smallest size of filter contact currently available (size 22) may removably be fitted in high contact density connectors. FIG. 7 is an end view of one part of a MIL C 38999 type connector showing the pin arrangement for 128 size 22 filter contacts.

Since the retaining plate 28 and grounding disc 40 share a common design (although manufactured from different materials) and the two spacer plates 56,58 are identical, it is possible to produce a connector in accordance with the present invention without the need for a large outlay on sophisticated and expensive mould and press tools.

I claim:

1. A contact for use in a filtered electrical connector, said contact comprising:

a longitudinally extending electrically conductive body;

a pair of flanges projecting outwardly from said conductive body and spaced from one another along the length of said conductive body;

a capacitive casing which surrounds a portion of said electrically conductive body between said pair of spaced flanges; and resilient conductive spacers held in compression between each end of said capacitive casing and an adjacent one of said spaced flanges to support said capacitive casing relative to said conductive body; wherein said contact further comprises:

a hollow shell extending from each of said pair of spaced flanges towards the adjacent end of said capacitive casing, each of said hollow shells overlying at least a part of the outer surface of said resilient conductive spacer between said flange from which said hollow shell extends and the adjacent end of said capacitive casing.

2. The invention set forth in claim 1, wherein each of said hollow shells defines an annular edge at the opposite end of said hollow shell to said one of said flanges from which said hollow shell extends, and wherein the distance between said annular edges of said hollow shells is slightly greater than the length of said capacitive casing therebetween.

3. The invention set forth in claim 1, wherein the outer diameters of each of said flanges and of said hollow capacitive casing are substantially the same so that the peripheral surfaces thereof form a substantially continuous surface.

4. The invention set forth in claim 1, wherein each of said resilient conductive spacers is a hollow body through which said conductive body extends.

5. A filtered electrical connector comprising one or more contacts as defined in claim 1.

6. A contact for use in a filtered electrical connector, said contact comprising:

a longitudinally extending electrically conductive body;

a pair of flanges projecting outwardly from said conductive body and spaced from one another along the length of said conductive body;

a filter element which surrounds a portion of said electrically conductive body between said pair of spaced flanges; and resilient spacers held in compression between each end of said filter element and an adjacent one of said spaced flanges to support said filter element relative to said conductive body; wherein said contact further comprises:

a hollow shell extending from each of said pair of spaced flanges towards the adjacent end of said filter element, each of said hollow shells overlying at least a part of the outer surface of said resilient spacer between said flange from which said hollow shell extends and the adjacent end of said filter element.

7. The invention set forth in claim 6, wherein each of said hollow shells defines an annular edge at the opposite end of said hollow shell to said one of said flanges from which said hollow shell extends, and wherein the distance between said annular edges of said hollow shells is slightly greater than the length of said filter element therebetween.

8. The invention set forth in claim 6, wherein the other diameters of each of said flanges and of said filter element are substantially the same so that the peripheral surfaces thereof form a substantially continuous surface.

9. The invention set forth in claim 6, wherein each of said resilient spacer is a hollow body through which said conductive body extends.

10. The invention set forth in claim 6, wherein at least one of said resilient spacers are conductive.

11. The invention set forth in claim 6, wherein said conductive body retains a degree of flexibility without damaging the filter element.

12. A filtered electrical connector comprising one or more contacts as defined in claim 6.

13. The invention set forth in claim 12, wherein said one or more contacts are crimp terminated to a wire and are rear insertable and rear removable from the connector.

14. A filtered electrical connector, said connector comprising:

a hollow connector casing;

a filter contact located within said connector casing;

a first non-conductive retaining plate, located within said connector casing, having an aperture formed therein through which said filter contact extends, and having one or more resilient tines formed about said aperture, said resilient tines contacting said filter contact behind a shoulder thereof to retain said filter contact in place; and a second retaining plate located within said connector casing, of substantially the same shape and size as said first retaining plate and having formed therein an aperture through which said filter contact extends, and having one or more resilient tines formed about said aperture, said resilient tines contacting said filter contact;

at least a part of the surface of said second retaining plate, extending over the surface of at least one of said one or more tines adjacent said aperture is electrically conductive so as to connect electrically to ground potential the external surfaces of the filter contact extending through the aperture therein.

15. The invention set forth in claim 14, wherein said second retaining plate is molded of resilient plastics material and said conductive part of said surface is provided by a layer of conductive material formed on said plastics material.

16. The invention set forth in claim 14, wherein said first retaining plate and said second retaining plate are molded of the same resilient plastics material.

17. The invention set forth in claim 15, wherein said layer of electrically conductive material is deposited over substantially the whole surface of said resilient plastics material from which said second retaining plate is molded.

18. The invention set forth in claim 15, wherein said conductive material is copper or silver or a mixture thereof.

19. The invention set forth in claim 14, wherein said connector casing is an electrically conductive connector casing around said filter contact and said second retaining plate and spaced apart therefrom and further comprising means for electrically connecting said connector casing and said second retaining plate.

20. The invention set forth in claim 19, wherein said means for electrically connecting said connector casing and said second retaining plate comprises an electrically conductive elastomer disposed in the aperture defined therebetween.

21. The invention set forth in claim 19, wherein said means for electrically connecting said connector casing and said second retaining plate comprises a flat spring strip of electrically conductive material positioned in the aperture defined therebetween, said strip having a number of resilient tines formed therein which, when said strip is in position in said aperture, contact both said connector casing and said second retaining plate.

* * * * *